US009687064B2

(12) United States Patent
Mellick et al.

(10) Patent No.: US 9,687,064 B2
(45) Date of Patent: Jun. 27, 2017

(54) SYSTEM FOR EASY TRANSPORT AND USE OF LEISURE APPARATUS

(71) Applicants: Jeffrey Harrison Mellick, New Canaan, CT (US); Beatrice Sophie Mellick, New Canaan, CT (US)

(72) Inventors: Jeffrey Harrison Mellick, New Canaan, CT (US); Beatrice Sophie Mellick, New Canaan, CT (US)

(73) Assignee: THE MELLICK GROUP, LLC, New Canaan, CT (US)

( * ) Notice: Subject to any disclaimer, the term of this patent is extended or adjusted under 35 U.S.C. 154(b) by 0 days.

(21) Appl. No.: 14/674,994

(22) Filed: Mar. 31, 2015

(65) Prior Publication Data

US 2016/0288953 A1 Oct. 6, 2016

(51) Int. Cl.
*A45F 3/14* (2006.01)
*A45C 11/20* (2006.01)

(52) U.S. Cl.
CPC ..... *A45F 3/14* (2013.01); *A45C 11/20* (2013.01)

(58) Field of Classification Search
CPC ..... B65D 21/0233; B65D 81/18; A45F 3/14; A45C 11/20
USPC ..... 224/627
See application file for complete search history.

(56) References Cited

U.S. PATENT DOCUMENTS 4,082,208 A * 4/1978 Lane, Jr. ..... A45F 3/04 220/4.27
4,377,075 A * 3/1983 Russo ..... B65D 81/18 62/372
5,429,541 A * 7/1995 Landon ..... A63H 33/32 383/4
5,755,477 A * 5/1998 McKnight ..... A45F 5/10 294/146
5,775,495 A * 7/1998 Lang ..... A45C 3/14 190/102
5,799,792 A * 9/1998 Abrums ..... B65D 21/0233 206/501
5,863,088 A * 1/1999 Kelly, Sr. ..... A45C 3/10 224/250
5,944,333 A * 8/1999 Kent ..... B62B 1/10 280/204
6,131,925 A * 10/2000 Weldon ..... B62B 1/12 280/30
6,460,746 B1 * 10/2002 Amram ..... A45F 3/047 224/579
2006/0144885 A1 * 7/2006 Smeuninx ..... A45F 3/047 224/629
2013/0299535 A1 * 11/2013 Lapointe ..... A45F 3/14 224/250

* cited by examiner

*Primary Examiner* — Nathan J Newhouse
*Assistant Examiner* — Scott McNurlen
(74) *Attorney, Agent, or Firm* — Todd S. Sharinn; Robert C. Brown

(57) ABSTRACT

A system of implements mutually and separably joined as a carrying unit for easy transport and subsequent use, the implements comprising a plurality of nestible buckets, a caddy removably receiving of the plurality of nestible buckets, optionally a collapsible chair removably attached to the caddy, at least one shovel removably attached to the caddy, and a carrying strap. Preferably, one of the buckets is modified to constitute a chamber for tempering food contained in the bucket at a non-ambient temperature during a holding period.

10 Claims, 4 Drawing Sheets

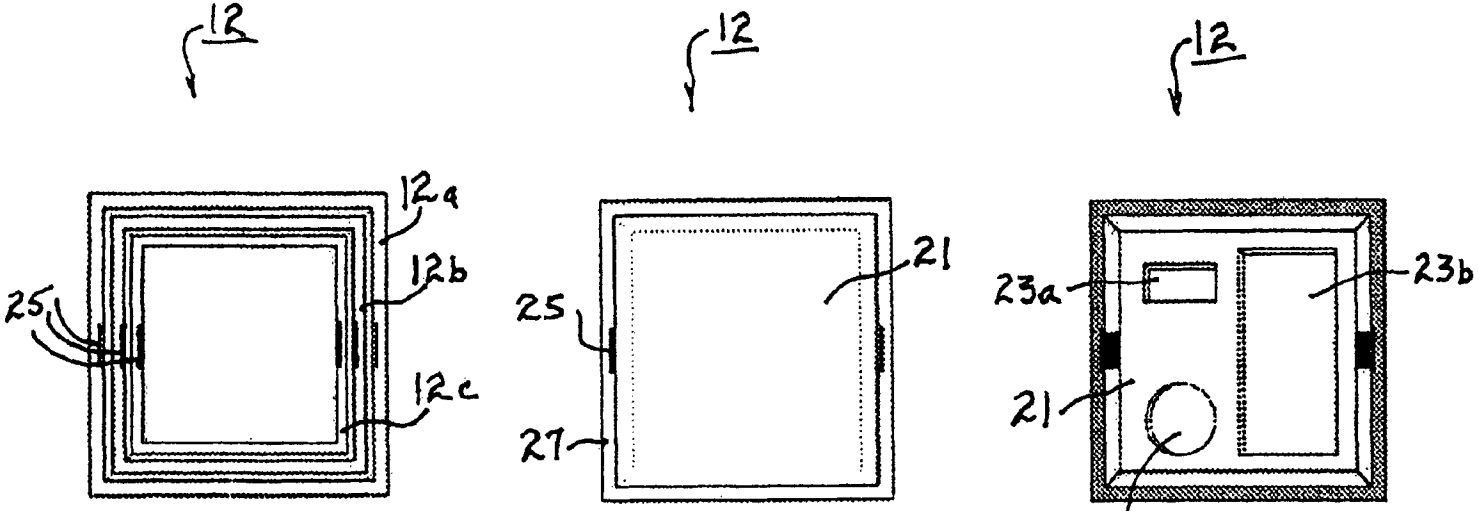
FIG. 3
FIG. 4
FIG. 5
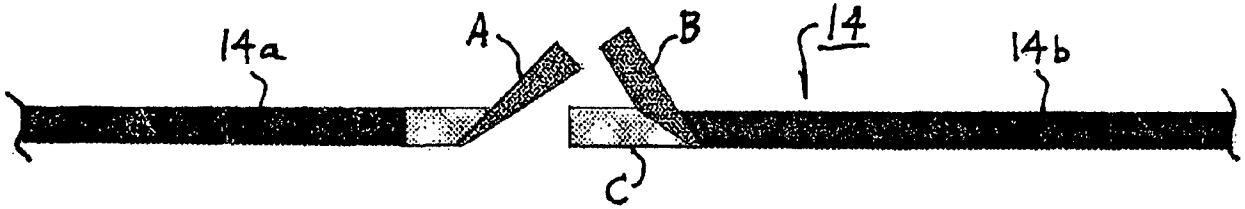
FIG. 6

SYSTEM FOR EASY TRANSPORT AND USE OF LEISURE APPARATUS

RELATIONSHIP TO OTHER APPLICATIONS AND PATENTS

The present application claims priority from U.S. Provisional Patent Application, Ser. No. 62/020,618, filed Jul. 3, 2014 by Jeffrey H. Mellick et al.

FIELD OF THE INVENTION

The present invention relates to a system of implements mutually and separably joinable for easy transport and subsequent use; more particularly, to such a system comprising nesting buckets (also referred to herein as "pails") of the nature of those used in children's play at the beach, a carrying caddy for use therewith, and one or more shovels removably attached to the caddy; and most particularly to such a system wherein the buckets and shovels further comprise specialized modifications to facilitate their being carried together and used separately in a beach or picnic setting. The system may be further configured to serve as a cooler for carrying foods and/or beverages, a tray for serving food and/or beverages, and may include a collapsible beach chair. (As used herein, "nesting" or "nestible" should be taken to mean configured to be capable of being nestingly and separably assembled into a unit, and "nested" should be taken to mean actually assembled thusly.)

BACKGROUND OF THE INVENTION

Many people enjoy leisure-time activities, frequently family-oriented, at lakeside and/or oceanside beaches or parks. Children enjoy digging in the sand and making sand constructions, which may be facilitated by the use of one or more buckets and simple shovels. In attending to such activities, families typically carry along various types of food and drink, which may be facilitated by the capability of keeping such food and drinks either warm or cool during a holding period before consumption. Handling food and drink during eating may be facilitated by providing level surfaces, not naturally available at beaches or parks, upon which to place food and drink securely. One or more lightweight collapsible chairs are also desirable for comfortable seating, as at a beach.

Carrying all such paraphernalia as individual items can be cumbersome, restrictive, and fatiguing. What is needed in the art is a system for the combined and easy transporting by one person of nested buckets having integral features for holding food receptacles and for tempering food being carried in the buckets; an encompassing caddy; at least one shovel; optionally at least one collapsible chair; and apparatus for unifying these elements into an easily transportable system.

SUMMARY OF THE INVENTION

A system of implements mutually and separably joinable for easy transport as a unit and subsequent use individually in accordance with the present invention comprises a plurality of nestible buckets, preferably decreasing in height and diameter such that the buckets may be nested, one within the next. At least one of the buckets has a carrying handle, preferably a flexible strap defining a bail. At least one of the buckets includes a bucket bottom having the underside thereof defining a small table when the bucket is inverted; the underside surface may be formed with one or more depressions to receive and support any of various food and drink containers. At least one of the buckets may be modified to accept heating or cooling means for tempering carried food during a holding period before consumption. The nested buckets preferably are gathered in a closable shroud or caddy. A lightweight collapsible beach chair optionally is removably attachable to the caddy. At least one shovel is removably attachable to the caddy or one of the nested buckets.

BRIEF DESCRIPTION OF THE DRAWINGS

The features described herein can be better understood with reference to the drawings described below. The drawings are not necessarily to scale, emphasis instead generally being placed upon illustrating the principles of the invention. Like numerals are used to indicate like parts throughout the various views, wherein:

FIG. 3 is a plan view showing the three buckets of FIG. 1 in nested conformation;

FIG. 4 is a plan view of a first embodiment of the underside of the largest bucket shown in FIG. 1;

FIG. 5 is a plan view of a second embodiment of the underside of the largest bucket shown in FIG. 1;

FIG. 6 is a plan view of an embodiment of an exemplary self-closing strap for use as a handle with any of the three buckets shown in FIG. 1;

DETAILED DESCRIPTION OF THE INVENTION

Figure 2:
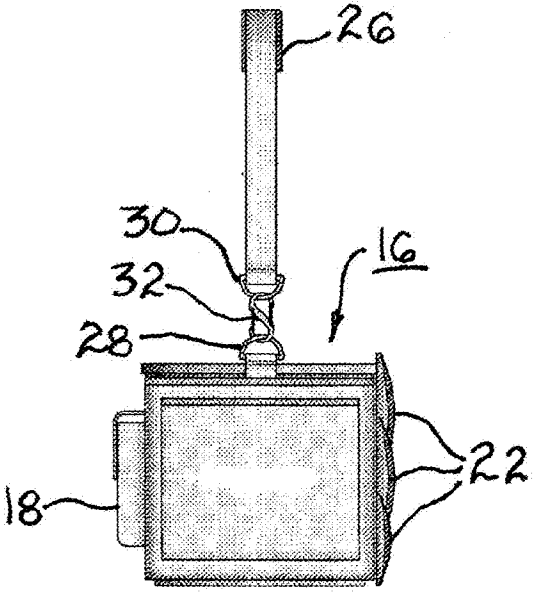
FIG. 2 is an end elevational view of a caddy for carrying and storing the nesting buckets shown in FIG. 1 and having a plurality of shovels removably attached to the caddy.
Figure 1:
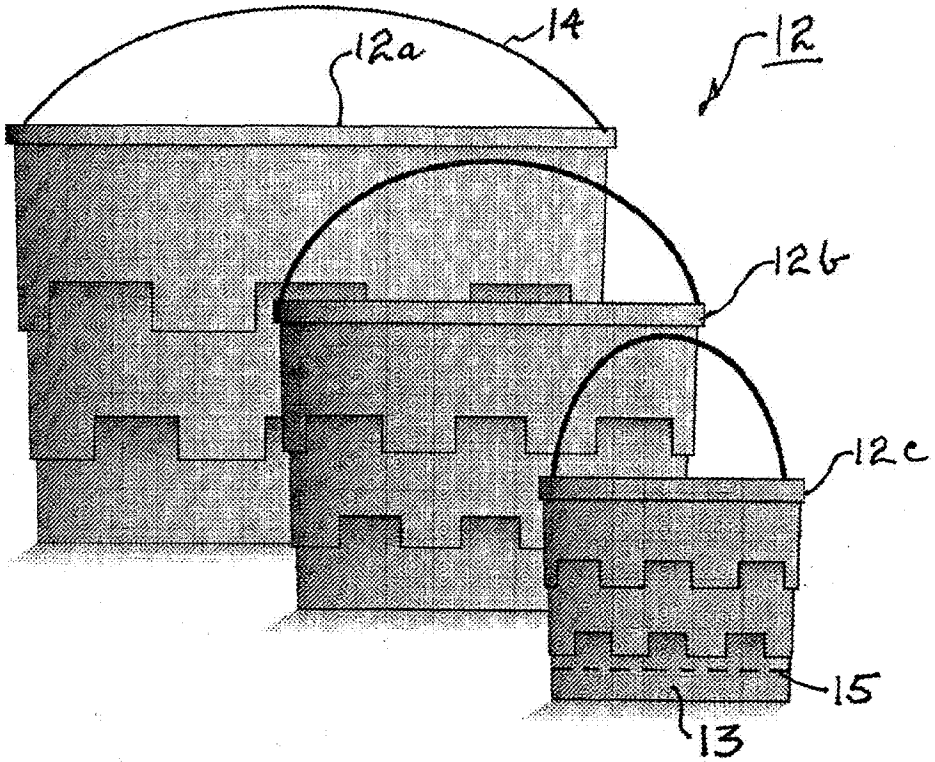
FIG. 1 is an elevational view of three exemplary nesting buckets in accordance with the present invention.
Figure 8:
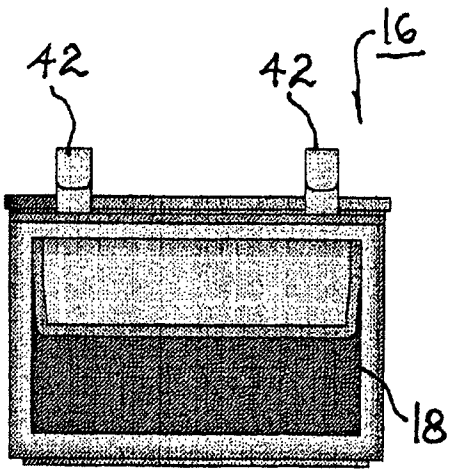
FIG. 8 is an elevational back side view of the caddy and shovels shown in FIG. 2.

Referring now to FIGS. 1 through 10, in a system 10 in accordance with the present invention, a plurality 12 of nesting buckets are here shown exemplarily as three buckets 12*a,b,c*. Other numbers of buckets are fully anticipated by the invention including only one bucket. Preferably, from outer bucket 12*a* to inner bucket 12*c*, each bucket is incrementally smaller in height and diameter to allow for the nesting of the buckets into a single unit 12 that can be carried by a user with, for example, a strap 14 secured to largest bucket 12*a*.

Figure 7:
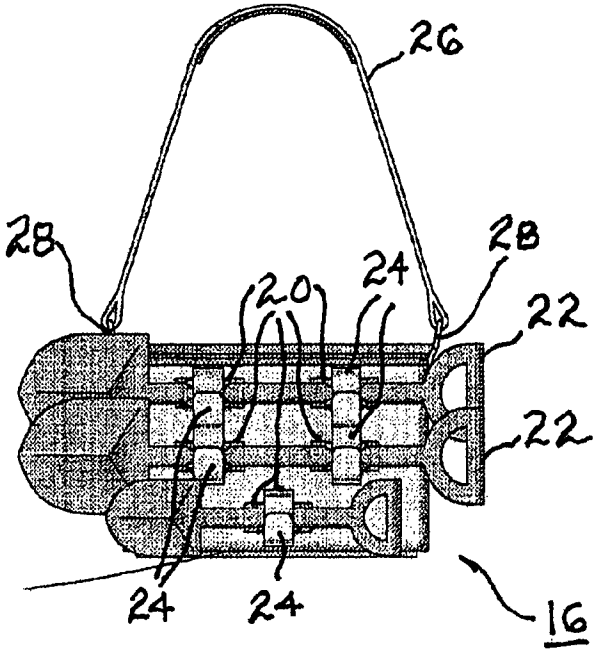
FIG. 7 is an elevational front side view of the caddy and shovels shown in FIG. 2.

A caddy 16 or bucket 12*a* is provided to store and carry the nested buckets 12. Caddy 16 thus substantially surrounds the outermost bucket in the set. Caddy 16 may comprise one or more pockets 18 of various sizes usable for storage and may also comprise one or more attachment slots 20 configured to receive the handle of a shovel 22 or other object. Once shovel 22 is secured in a slot 20, it may be strapped down to caddy 16 by means of a locking strap 24, which may comprise a hook-and-loop fastener, locking snap, or any other suitable means for closing such a locking strap around a shovel handle. Caddy 16 may further include a shoulder strap 26 or handle for carrying caddy 16 with buckets. As seen in FIG. 7, caddy 16 may comprise a pair of D-rings 28 that are non-removably secured to strap 26 via eyes in strap 26.

The present invention is not limited to only the arrangement shown in FIG. 7, but may include alternative means for securing a strap or handle to the caddy, for example as shown in FIG. 2, comprising a pair of D-rings 30 and a clasp 32 secured around the corresponding D-rings of the caddy and strap. This arrangement allows for strap 26 to be removed from caddy 16 when the strap is not in use, or for strap 26 to be replaced by an alternate strap or handle.

Caddy 16 may be configured with tapered dimensions such that an opening at the top of the caddy is larger than an opening at the bottom. Tapering the dimensions in such a manner prevents the bucket or buckets from sliding through the bottom of an open-bottom caddy. Caddy 16 may be formed of any desired material, e.g., a canvas material, such as the material used for a canvas tote bag. Caddy 16 alternatively may be formed of other suitable natural or synthetic material.

System 10 is further configured to temper food and beverages being carried in one of buckets 12*a,b,c*. Preferably, the smallest bucket 12*c* in the set of buckets 12 (i.e. the top bucket in the set of nested buckets) comprises a tempering chamber 13 at the bottom of the bucket. Tempering chamber 13 may be provided with removable tempering means either cold or hot, e.g., ice or a heated element (not shown), separated from the food or beverages by a divider 15. Thus, the tempering means on the bottom is separated from the rest of the bucket, leaving a dry compartment on top for storing items such as food or beverages that are intended to be kept cold or warm at a non-ambient temperature during transport of the food or beverages, or while they are being held for later consumption. Such a tempering chamber and divider may be configured to be inserted into any of the buckets. In another embodiment of the present invention, smallest bucket 12*c* may itself serve as a cooler with its own lid (not shown) and compartments for drinks and/or ice and food which are separated by a divider.

Referring to FIGS. 4 and 5, the bottom 21 of at least one, and preferably each, bucket 12*a,b,c*, when overturned, defines a flat surface which can act as a small tray or table. Further, the bottoms of any or all of buckets 12*a,b,c* may be formed with one or more shaped indentations 23*a,b,c* that can function as cup holders or food/tray holders (food containers). In an exemplary embodiment shown in FIG. 5, indentations include one indentation that is a small rectangle 23*a* for holding an item such as a juice box, another indentation that is a larger rectangle 23*b* for holding a plate, and a third indentation 23*c* that is round for holding an item such as a cup or soda can. Additional or alternative indentations 23 may be formed in bottoms 21 as desired.

As noted above, one or more of buckets 12*a,b,c* may be configured with a strap 14. A currently preferred embodiment of a strap in accordance with the present invention is shown in FIG. 6, as described below. Strap 14 is preferably formed from a nylon material.

Preferably, each bucket comprises a plurality of openings 25 in the lip 27 of the bucket, through which strap 14 may be inserted to secure strap 14 to the bucket. Each bucket further comprises a tunnel portion (not shown) in the bottom of the bucket through which the strap or handle is to be inserted between the opposing openings 25.

Strap 14 may also comprise means to detach the strap from the bucket. In one exemplary embodiment shown in FIG. 6, one end 14*a* of continuous strap 14 comprises a double sided hook-and-loop material (A), and the opposite end 14*b* of strap 14 comprises two corresponding portions of hook material B and loop material C. Portion A may be inserted between Portions B and C in order to secure the two ends of the strap together, for example, near the top of the arc of the strap in FIG. 1. If the user wishes to remove the strap from the bucket, the two ends can be detached in known fashion and the strap removed from the openings in the lip of the bucket and the tunnel in the base of the bucket. The strap can be also reinserted for further use. In alternative embodiments, the strap may be made from an alternative material that is suitable for use as a strap, and the ends of the strap can be attached to each other using an alternative attachment means.

Figure 10:
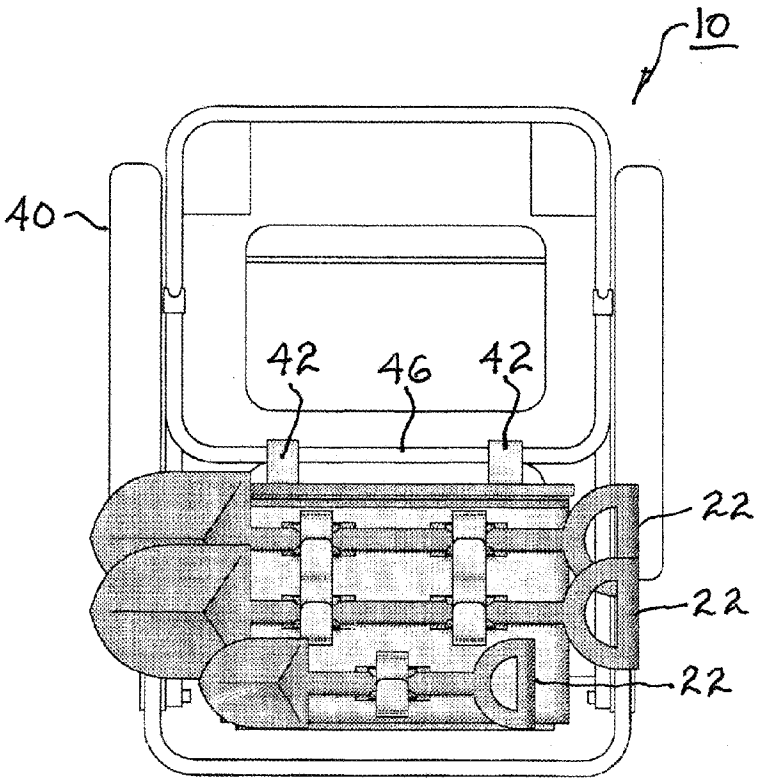
FIG. 10 is an elevational side view of the system shown in FIG. 9.
Figure 9:
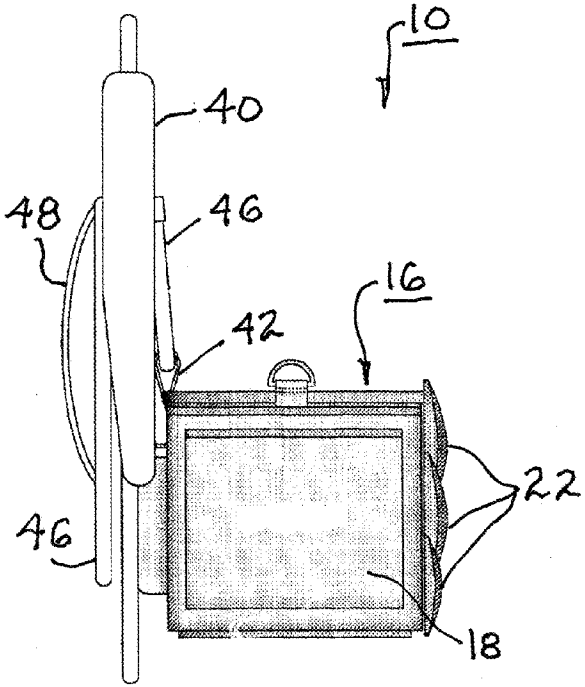
FIG. 9 is an elevational end view of an optional system in accordance with the present invention.

FIGS. 9 and 10 show an alternate arrangement for transporting caddy 16 containing buckets 12 by securing caddy 16 and shovels 22 to an optional collapsible beach chair 40. Caddy 16 may be configured with a plurality of closable loops or straps 42 that are secured to caddy 16. Straps 42 may include hook-and-loop fasteners or other suitable means for opening and closing such straps. Straps 42 are configured to go around a section of a beach chair, such as the plastic or metal frame 46 of the chair, so that a user can removably attach the caddy to the beach chair. One or more shoulder straps 48 are removably attached to frame 46, forming thereby system 10 in accordance with the present invention. This arrangement allows the user to carry the caddy, shovels, and bucket kit in combination with the beach chair, by carrying the beach chair in a fashion similar to a back pack. Other components that may be combined in a system in accordance with the present invention include but are not limited to one or more towels and an umbrella (not shown).

The present invention therefore greatly increases the convenience for beachgoers or picnickers by providing an all-encompassing system that allows the user to carry together and store all of the items to be brought along as a single, transportable kit or unit.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system of implements mutually and separably joined for easy transport as a portable unit and subsequent use as individual implements, said implements comprising:

a) a plurality of nestible buckets incrementally smaller in height and diameter from a largest bucket to a smallest bucket;

b) a caddy removably receiving said plurality of nestible buckets;

c) at least one shovel removably attached to one of said caddy and said plurality of nestible buckets; and d) at least one carrying strap removably attached to said caddy, wherein at least one of said plurality of nestible buckets includes at least one shaped indentation suitable as a food holder when said bucket is in an inverted position defining a small table, wherein said plurality of buckets are individually separable and may be used individually, and wherein at least one of said nestible buckets includes a plurality of openings in a lip of said bucket and a tunnel portion in the bottom of said bucket, and a detachable strap passed through said plurality of openings and said tunnel portion.

2. A system in accordance with claim 1 wherein said plurality of nestible buckets are three in number.

3. A system in accordance with claim 1 wherein said at least one shovel and said plurality of nestible buckets are suitable for beach use with sand.

4. A system in accordance with claim 1 further comprising an apparatus for attaching to said caddy a component selected from the group consisting of a beach chair, a towel, and an umbrella.

5. A system in accordance with claim 1 further comprising a collapsible, portable beach chair.

6. A system in accordance with claim 1 further comprising a tempering chamber disposable within at least one of said plurality of buckets for receiving removable tempering material to maintain a non-ambient temperature in food and drink being carried adjacent said chamber.

7. A system in accordance with claim 6 wherein a one of said plurality of buckets defines a cooler.

8. A system in accordance with claim 7 wherein said cooler includes a lid, at least one internal compartment, and at least one divider.

9. A system in accordance with claim 1 further comprising a plurality of said shaped indentations formed in the bottom of said at least one bucket and having shapes selected from the group consisting of rectangle, circle, square, and combinations thereof.

10. A system in accordance with claim 1 wherein said detachable strap includes hook-and-loop material for detachably connecting the ends thereof.

* * * * *